US006783090B2

(12) United States Patent
Zehr

(10) Patent No.: US 6,783,090 B2
(45) Date of Patent: Aug. 31, 2004

(54) BEARING SHEAR BLOCK

(75) Inventor: Melvin A. Zehr, Caldwell, ID (US)

(73) Assignee: Diamond Z Manufacturing, Caldwell, ID (US)

( * ) Notice: Subject to any disclaimer, the term of this patent is extended or adjusted under 35 U.S.C. 154(b) by 197 days.

(21) Appl. No.: 10/010,177

(22) Filed: Nov. 13, 2001

(65) Prior Publication Data

US 2002/0056771 A1 May 16, 2002

Related U.S. Application Data

(60) Provisional application No. 60/249,401, filed on Nov. 15, 2000.

(51) Int. Cl.[7] ..... B02C 13/31

(52) U.S. Cl. ..... 241/32; 384/624

(58) Field of Search ..... 384/593, 606, 384/622, 624; 241/32, 236, 189.1, 101.2, 188.1

(56) References Cited

U.S. PATENT DOCUMENTS

| | | | | | |
|---|---|---|---|---|---|
| 3,966,128 | A | | 6/1976 | Anderson et al. | 241/73 |
| 4,082,232 | A | * | 4/1978 | Brewer | 241/236 |
| 4,289,360 | A | * | 9/1981 | Zirin | 384/462 |
| 4,585,180 | A | | 4/1986 | Potts | 241/186 |
| 4,846,411 | A | | 7/1989 | Herron et al. | 241/101.7 |
| 4,923,319 | A | | 5/1990 | Dent | 403/2 |
| 4,997,135 | A | | 3/1991 | Zehr | 241/101.7 |
| 5,375,784 | A | | 12/1994 | Worley | 241/37.5 |
| 5,419,502 | A | | 5/1995 | Morey | 241/101.7 |
| 5,507,441 | A | | 4/1996 | De Boef et al. | 241/73 |
| 5,542,617 | A | | 8/1996 | Rajewski | 241/101.761 |
| 5,582,482 | A | | 12/1996 | Thom, Jr. et al. | 384/434 |
| 5,720,440 | A | | 2/1998 | Bonner et al. | 241/101.761 |
| 5,794,910 | A | | 8/1998 | Granger | 248/548 |
| 5,803,380 | A | | 9/1998 | Brand et al. | 241/101.761 |
| 5,820,230 | A | | 10/1998 | Freeman | 305/107 |
| 5,911,372 | A | * | 6/1999 | Williams, Jr. | 241/32 |
| 6,413,048 | B1 | * | 7/2002 | Muylaert | 416/134 A |

* cited by examiner

*Primary Examiner*—Mark Rosenbaum
(74) *Attorney, Agent, or Firm*—Robert L. Shaver; Dykas, Shaver & Nipper

(57) ABSTRACT

An improved hammermill assembly utilizing shear bolts and shear plates designed to break upon extreme loads exerted upon the hammermill assembly, thereby reducing the occurrence of damage to the hammermill assembly or attached equipment.

23 Claims, 9 Drawing Sheets

BEARING SHEAR BLOCK

PRIORITY

Priority. This application incorporates by reference and claims priority from provisional application serial No. 60/249,401, filed on Nov. 15, 2000, entitled "Retractable Rod Screens."

DESCRIPTION

BACKGROUND OF THE INVENTION

The present invention generally relates to grinding machines, and more particularly relates to the mounting of bearings used on grinding machine shafts.

Many different kinds of grinding machines are known in the prior art, including U.S. Pat. No. 4,997,135 to Zehr and U.S. Pat. No. 5,720,440 to Bonner, et al. Grinding machines include those machines that use a grinding means such as hammer mills, drum chippers, and wheel chippers to grind various materials. Grinding machines are used for grinding tree stumps and slash from logging operations; construction debris from damaged buildings, landfill garbage, tires for compacting purposes, and even apples for apple juice.

Generally and typically, these grinding machines utilize a grinding assembly attached to a frame to grind the material. One common type of grinding assembly is a hammermill assembly formed by a rotating shaft to which radially extending hammers are affixed. This hammermill shaft is mounted to bearing blocks and driven by a drive shaft which itself is interconnected by a clutch in some fashion to an engine assembly. The hammermill assembly is typically interfitted within a semi-circular hammermill screen. In use, material to be ground is dropped into a hopper from which it passes into the rotating hammers where it is broken apart and/or pulverized. The hammermill screen serves as a sieve, allowing ground material smaller than the pre-determined sieve holes of the hammermill screen to pass out of the hammermill assembly onto some sort of discharge system, conveyor, auger, or other device by which it is carried away. Material larger than the pre-determined sieve holes of the hammermill screen is kept in contact with the rotating hammers of the hammermill and reground until it is of a small enough size to pass through the sieve holes. In grinding machines for large materials, such as tree stumps or garbage, the shaft is typically quite large and heavy, and the heavy hammers create a very high rotating mass.

One major problem with such grinding machines occurs when certain materials (i.e., refrigerator compressors, manhole covers, engine blocks, rebar pieces, propane tanks, etc.) are fed into the grinding machine and when the grinding machine is over-loaded. The types or quantities of materials in the grinder can cause the parts of the grinding machine to stop rotating and cause damage to the grinding apparatus. For example, when the rotating hammers of a hammermill abruptly stop, the rotational energy must be transferred elsewhere. This energy is transferred to the shaft which then attempts to transfer the energy to the frame. When the shaft is solidly mounted to the frame and the frame will not absorb the energy, the energy is transferred back on to the shaft and the hammers, and back against the drive mechanism of the apparatus. As a result the grinding machine can literally tear itself apart, as the energy is turned back onto the machine itself causing damage to the parts of the grinding assembly, such as the hammers or grinding teeth, the grinding shaft, and grinding bearings, as well as damage to the drive mechanism. Other damage such as injury to persons and property in the vicinity of the grinding assembly can also occur. The cost from such sudden occurrences can be tremendous as repair and/or replacement costs are incurred as well as lost time, and productivity, to say nothing of the possible costs to lives and property that can be damaged.

What is needed is a method for dissipating the energy of such a sudden stoppage of rotation of the shaft, thereby alleviating damage to the grinding machine. What is also needed is a means for quick and easy replacement of parts if the grinding machine breaks. The present invention solves these needs.

SUMMARY OF THE INVENTION

The present invention is an improvement to grinding machines. Commonly, such a grinding machine will have a shaft and attached hammers for breaking apart large pieces of diverse material. This shaft will have first end extending to a second end, and is rotatable while attached to a frame through use of at least one pair of bearing assemblies. A first bearing assembly will support the first shaft end, and a second bearing assembly will support the second shaft end. The bearing assemblies are connected to a first shear plate having at least one hole that allows a shearing device to pass through. These shearing devices connect a first shear plate to the frame. The shearing devices are designed to have a lower resistance to a shearing force which is created when the rotation of the grinding device is jammed. When a jam occurs the shearing devices break. This releases the energy and prevents damage to other parts of the machinery.

In one embodiment of the present invention, the frame of the hammermill has a first plurality of shear bolt holes which are able to receive a first plurality of shear bolts. The frame further has a second plurality of shear bolt holes for receiving a second plurality of shear bolts. The first bearing assembly is able to attach to a first shear plate, and the second bearing assembly is able to attach to a second shear plate. Each of these shear plates have shear bolt holes which align with the shear bolt holes of the frame, so that the first shear plates' shear bolt holes align with the frame's first plurality of shear bolt holes. Thus, the first shear plate with attached first bearing assembly could be attached to the frame through use of shear bolts. Likewise, the second shear plate with attached second bearing assembly could be attached to the frame at the second plurality of shear bolt holes using the second plurality of shear bolts.

In use, if the grinding machine's shaft becomes jammed or has other rotational difficulties, at least one or more of the shear bolts which bolt the shear plates to the frame will break, rather than the shaft or other components of the grinder or the bearing bolts holding the bearing assemblies to the plates (if present). By allowing the shear bolts to break, two advantages are shown. First, the damage caused by the jamming will be limited to replacement of the shear bolts which are designed to break at certain desired stress levels. Thus the potential damage to the remaining parts of the machine will be limited. Second, by allowing the shear bolts to break, the ability to fix the damage caused will be considerably easier. A user could simply dislodge whatever material had jammed the hammermill and then merely replace the broken shear bolt or bolts with a new shear bolt or bolts, refastening the bearing assemblies back into place.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
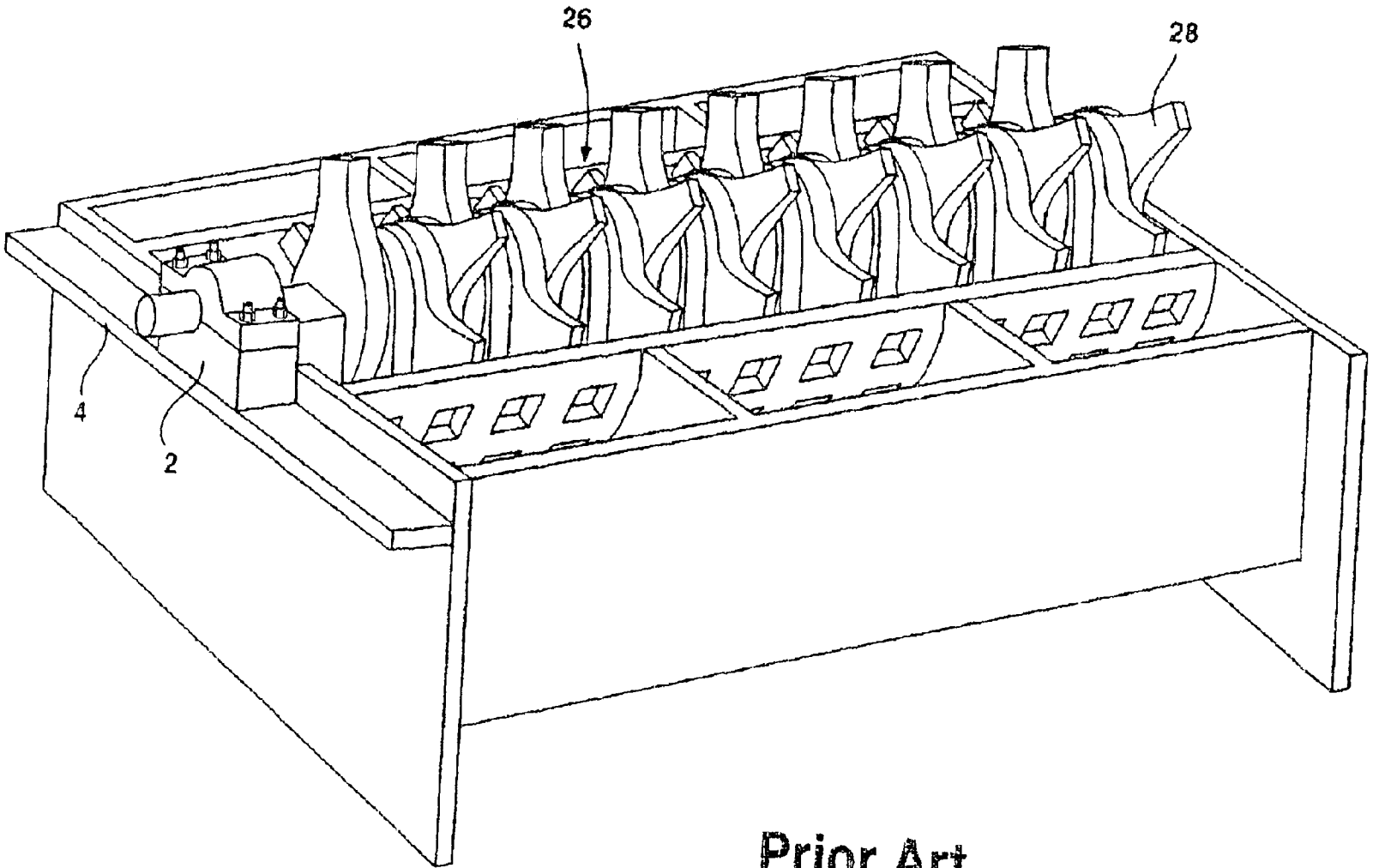
Prior Art Fig. 1
FIG. 1 is an environmental view of a prior art hammermill assembly.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring initially to FIG. 1, the prior art method of attaching a hammermill within a hammermill assembly is shown. In such an arrangement, bearing assembly 2 is bolted directly to frame 4, in a fixed manner. This bearing assembly supports a rotatable shaft 26 for grinding garbage and the like. In such a hammermill assembly, a number of hammers 28 will be attached to the rotatable shaft 26.

Figure 2:
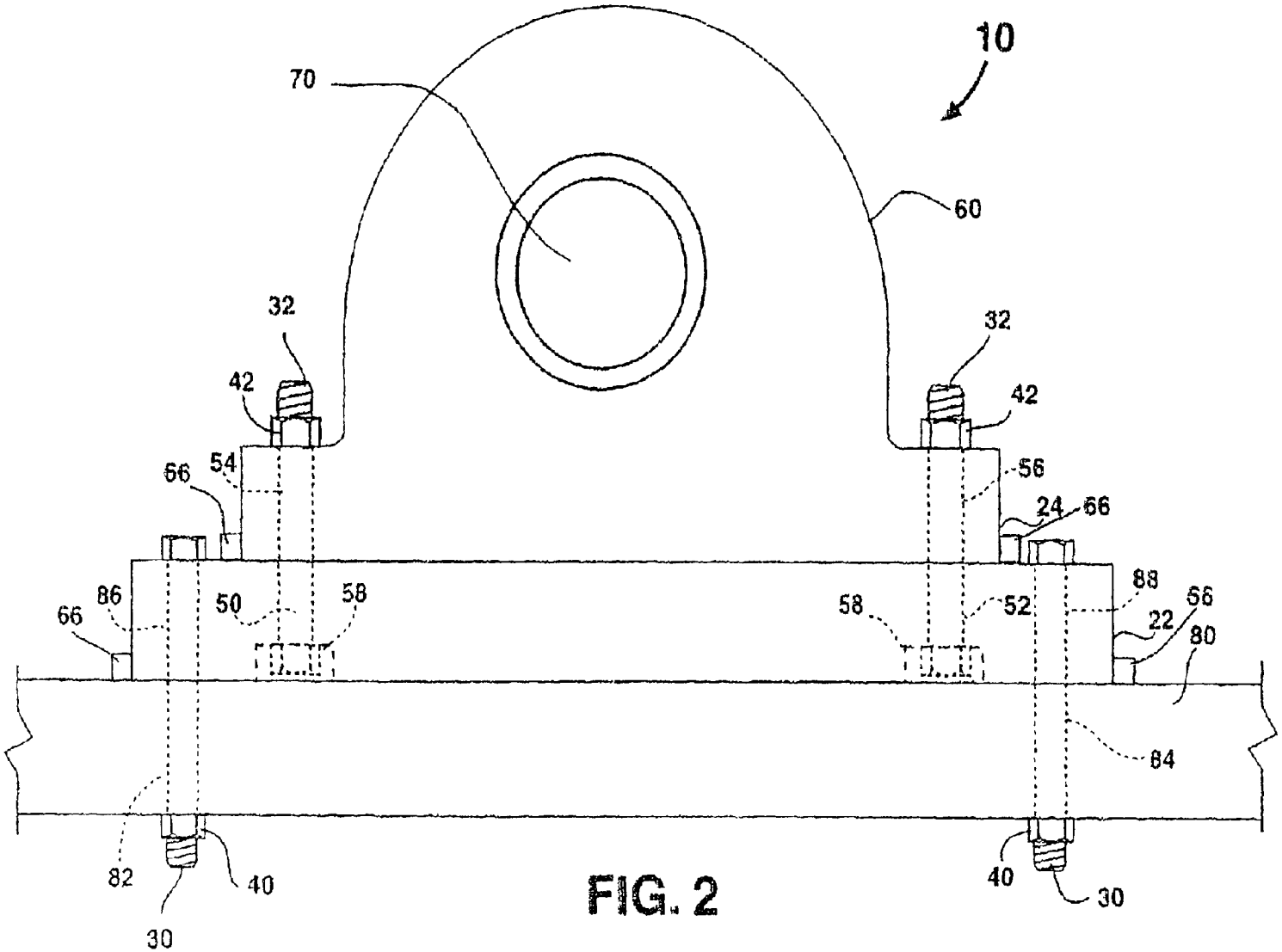
FIG. 2 is a side elevational view of a first embodiment of the present invention.
Figure 3:
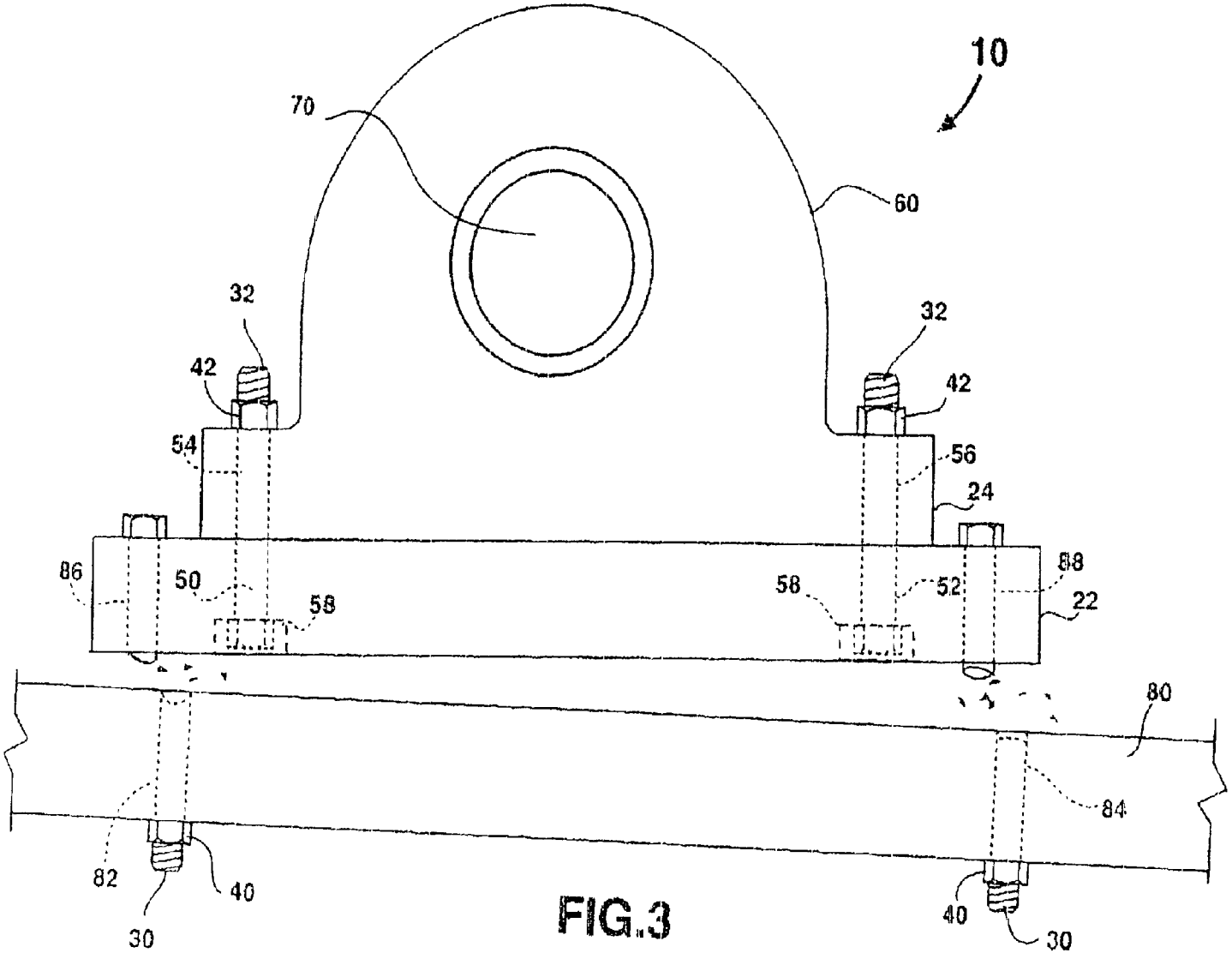
FIG. 3 is a view of the embodiment of FIG. 3 representing the breakaway bolts to breaking.

FIG. 2 shows one embodiment of the present invention. This embodiment of the present invention shows a bearing shear block assembly 10 utilizing a single shear plate 22. In such an embodiment, a bearing assembly 60 would be able to easily attach to the first shear plate 22 without use of an intermediary second shear plate, as shown in some of the other embodiments. The bearing assembly 60 is attached to the shear plate 22 by use of at least two plate bolts 32 and at least two plate nuts 42. This shear plate 22 in turn is able to be attached to the frame 80 of the grinding machine through use of at least two shear bolts 30 fastened with at least two shear nuts 40. In use, if the load on the hammermill assembly 20 becomes too great, the shear bolts 30 and/or shear nuts 40 would break, thereby releasing the load (as shown in FIG. 3). This serves to reduce the likelihood that a different component, such as the bearing assembly 60, the transmission, drive shaft 70, or the engine itself will fail.

This disclosure is intended to include the use of any type of bearing assembly with a shear plate and shearing means regardless of the means of attachment or number of intermediary shear plates between the bearing assembly and the frame itself. As will be shown in the other embodiments, the shearing means may be bolts, or pins or any other attachment means as long as the shearing means is adapted so as to break when confronted by a desired shearing force. Likewise, the bearing mounting assembly may be attached to the shear plate through any one of a number of ways including bolts, nuts, screws, brackets, or any other means. The bearing mounting assembly generally have a greater resistance to shear stress than the shearing devices so as to ensure that the shearing devices break.

Referring back to FIG. 2, the present invention may further comprise bearing stops 66 or guides located on the upper surfaces of the frame 80 and the shear plate(s) 22 for assisting in quick and easy installation of components of the present invention. In one embodiment, these bearing stops 66 would comprise HR square stock attached perpendicular to the length of the frame 80 or shear plate 22.

Referring now to FIG. 3, shown is an environmental view of the embodiment of FIG. 2 as would be seen if a load is exerted on the hammermill assembly which results in the breakage of the shear bolts 30. The shear bolts 30 utilized with the present invention can be configured however necessary or desired by the operator of the hammermill assembly, so that varying degrees of loads can be borne by the invention before the shear bolts 30 break. If such breakage occurs, reconfiguring the device is merely as easy as removing whatever caused the jam, reorienting the equipment within the hammermill assembly, removing the broken shear bolts 30, replacing them with new shear bolts 30, and fastening the new shear bolts 30 down through use of shear nuts 40. Likewise, the shear nuts 40 themselves could be configured to be the component desired to fail.

Figure 4:
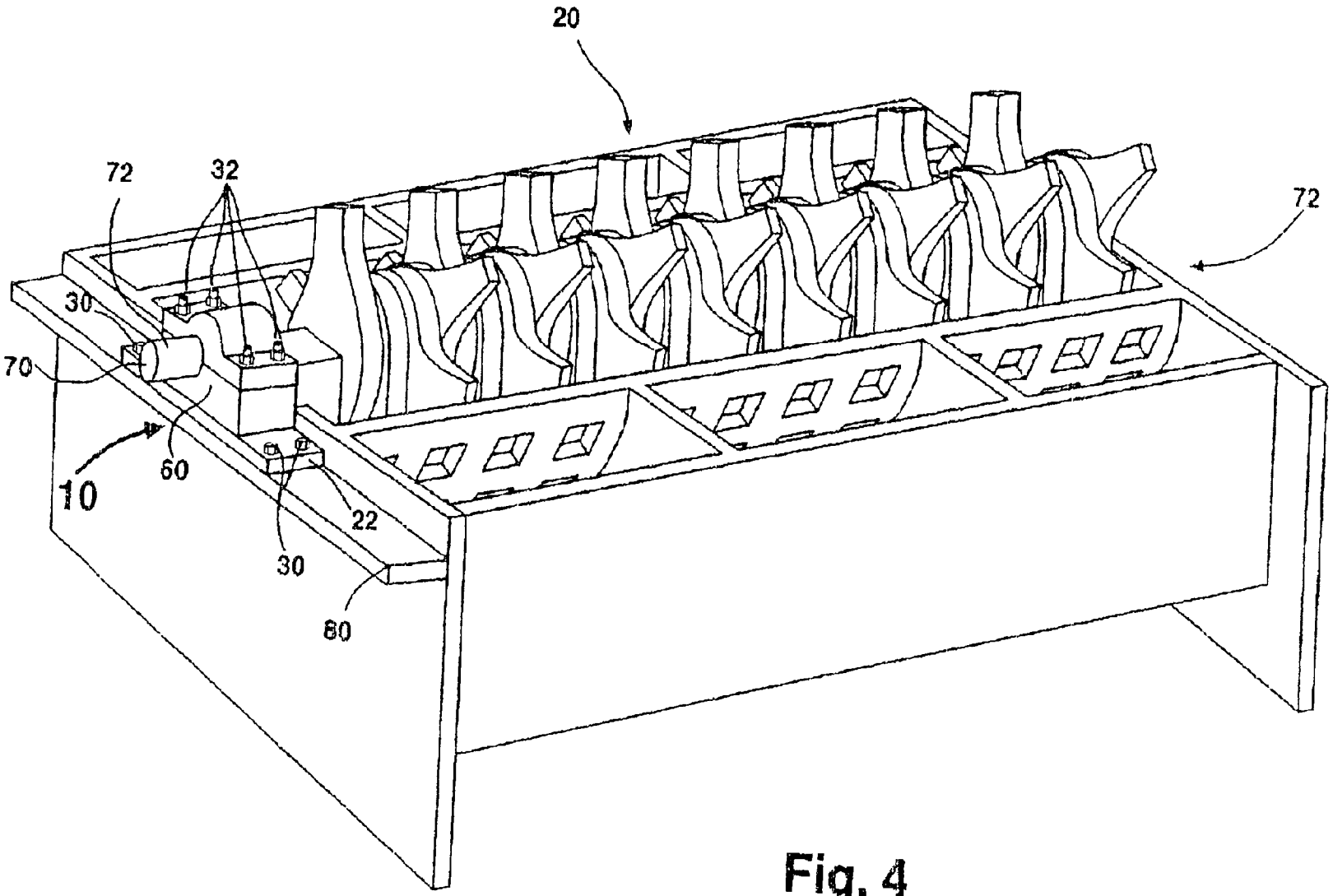
FIG. 4 is an environmental view of a second embodiment of the present invention.

Referring now to FIG. 4, an environmental view of one embodiment of the present invention is shown. The hammermill assembly 20 is shown. In this Figure, it can be seen that the bearing assembly 60 is able to be attached to the frame 80 through use of a shear plate 22. Shear bolts 30 fasten the shear plate 22 to the frame 80. Plate bolts 32 and nuts are utilized to attach the bearing assembly 60 to the shear plate 22.

Figure 5:
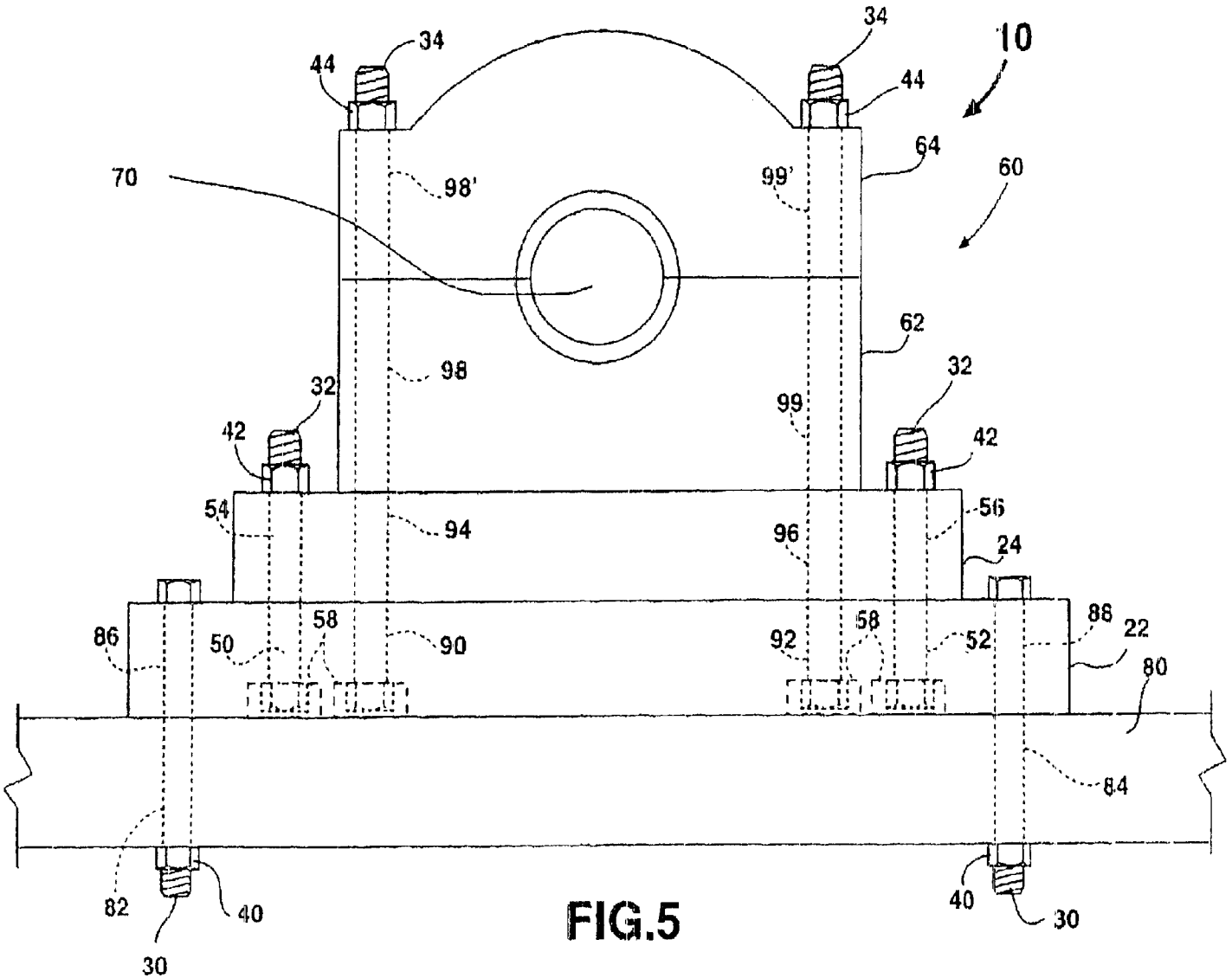
FIG. 5 is a side, elevational view of a third embodiment of the present invention.

Referring now to FIG. 5, this figure shows a side elevational view of another embodiment 10 of the present invention. The invented bearing shear block system 10 is utilized to prevent or lessen damage to a hammermill assembly. The frame 80, preferably a mill cross member of the hammermill assembly will have therethrough at least one first shear bolt hole 82 and at least one second shear bolt hole 84. These shear bolt holes (82, 84) are for receiving shear bolts 30. In another embodiment, FIG. 3 shows shear bolts 30 being sheared and releasing the bearing assembly 60. To achieve this, shear bolts 30 are configured to break at a lower strain than plate bolts 32. Likewise, the shear nuts 40 could be configured to break rather than the shear bolts 30. To accommodate the placement of the plates and assemblies recesses 58 are placed within the shear plates and assemblies.

It is preferred that a pair of first shear bolt holes 82 and a pair of second shear bolt holes 84 be provided. In such an embodiment, the first shear bolt holes 82 will be oriented symmetrically about a centerline with the second shear bolt holes 84, with individual pair members being oriented generally parallel to the centerline. The spacing and size of these components will vary depending on the size and weight of the hammermill. It is to be noted that within this disclosure, all measurements, distances, and numbers are intended in reference to this particular embodiment and are not intended as a limitation of the invention in general.

Referring again to FIG. 5, a first shear plate 22 is likewise configured with at least one fourth shear bolt hole 88 and at least one third shear bolt hole 86. These shear bolt holes (86, 88) will be configured and arranged so that they align with the shear bolt holes (82, 84) of the frame 80. Thus, a plurality of shear bolts 30 could be inserted through each upper shear bolt hole (86, 88) into each lower shear bolt hole (82, 84) and fastened with a plurality of shear nuts 40. Thus, the shear nut 40 is utilized to fasten the first shear plate 22 to the frame 80. The terms "shear nuts" and "shear bolts" are used to indicate the function of the nut-bolt pair and are not intended to indicate necessarily for example that a particular "shear nut" has shearing capabilities, for the mated "shear bolt" may have the ability to shear instead.

Likewise, the third shear bolt hole 86 and the first shear bolt hole 82 align and are able to be attached together through use of a shear bolt 30 and shear nut 40. It is preferred that a pair of third shear bolt holes and a pair of fourth shear bolt holes be provided, configured and arranged so that they align with the preferred pairs of first and second shear bolt holes in the frame. Likewise, an appropriate number of shear bolts and nuts will be provided. Different diameter shafts on different weights would obviously require bearing assemblies of different size and different configurations of bolts, nuts and spacings.

This first shear plate 22 will further have at least one first plate bolt hole 50 and at least one second plate bolt hole 52. These plate bolt holes (50, 52) are for receiving therethrough plate bolts 32 able to be fastened with plate nuts 42. It is preferred and anticipated that recesses 58 may be formed therein the first shear plate 22 for receiving the heads of such plate bolts 32. It is preferred that a pair of first plate bolt holes 50 and a pair of second plate bolt holes 52 be provided. The preferred spacing of the pair of first plate bolt holes 50 from the pair of second plate bolt holes 52 for the above described configuration is 23.00 inches. The preferred spacing between the first plate bolt holes is 4.50 inches. The preferred spacing between the second plate bolt holes is 4.50 inches. The preferred diameter of these plate bolt holes being 1 5/16 inches. The preferred recesses 58 comprise 1 7/8 inch by 2 3/8 inch by 7/8 inch deep mill pockets, a size that allows the preferred bolt heads to interfit therein. The preferred plate bolts 30 are 1 1/4 inch ×7.0 inch NC hex bolts (grade 8). The preferred plate nuts 42 are 1 1/4 NC grade 8 nuts (preferably with a 1 1/4 SAE flat washer (grade 8).

In the preferred embodiment, the first shear plate 22 further has at least one first bearing assembly bolt hole 90 and at least one second bearing assembly bolt hole 92. These bearing assembly bolt holes (90, 92) are for receiving therein bearing assembly bolts 34 which will be fastened through use of bearing assembly nuts 44. Likewise, recesses 58 may be formed therein the first shear plate 22 for receiving the heads of the bearing assembly bolts 34.

A second shear plate 24 is able to work with said first shear plate 22. In this embodiment, a second shear plate 24 is utilized, however in other embodiments, the second shear plate 24 may form part of the bearing assembly 60 itself, or may be absent. The second shear plate 24 has at least one third plate bolt hole 54 and at least one fourth plate bolt hole 56. These plate bolt holes (54, 56) are for aligning with the plate bolt holes (50, 52) of the first shear plate 22 and for receiving therethrough the plate bolts 32 able to attach to the plate nuts 42 as well.

Additionally, this embodiment utilizes at least one third bearing assembly bolt hole 94 and at least one fourth bearing assembly bolt hole 96 for receiving therethrough said bearing assembly bolts 34, thereby joining the first plate 22 to the second plate 24 to the bearing assembly 60. In such an embodiment, plate bolts 32 are used to fasten the first shear plate 22 to the second shear plate 24. Likewise, bearing assembly bolts 34 are utilized to attach the first shear plate 22 and second shear plate 24 to the bearing assembly 60.

The preferred spacing of the pair of third plate bolt holes 54 from the pair of fourth plate bolt holes 56 is 23.00 inches. The preferred spacing between the third plate bolt holes 54 is 4.50 inches. The preferred spacing between the fourth plate bolt holes 56 is 4.50 inches. The preferred diameter of these plate bolt holes (54, 56) is 1 5/16 inches. The preferred recesses 58 comprise 1 7/8 inch by 2 3/8 inch by 7/8 inch deep mill pockets, a size that allows the preferred bolt heads to interfit therein.

The preferred spacing of the pair of third bearing assembly bolt holes 94 from the pair of fourth bearing assembly bolt holes 96 is 15 3/8 inches. The preferred spacing between the third bearing assembly bolt-holes 94 is 3 7/8 inches. The preferred spacing between the fourth bearing assembly bolt holes 96 is 3 7/8 inches. The preferred diameter of these bearing assembly bolt holes (94, 96) is 1 3/8 inches. The preferred bearing assembly bolts 34 are 1 1/4 inch×16 1/2 inch NC hex bolts, grade 8. The preferred bearing assembly nuts 44 are 1 1/4 inch NC grade 8 nuts, preferably with 1 1/4 inch SAE flat washers (grade 8).

Attaching to the shear plates (22, 24) of the present invention 10 is a bearing assembly 60. This bearing assembly 60 may be of solitary construction, or in the embodiment shown in this figure, may comprise a first bearing assembly half 62 which attaches a second bearing assembly half 64. The shaft of the hammermill will be able to be inserted through the bearing assembly, allowing for rotation of the shaft within the bearing assembly.

In the embodiment shown, the bearing assembly 60 has a first bearing assembly half 62. This first bearing assembly 62 has therethrough at least one fifth bearing assembly bolt hole 98 and at least one fifth bearing assembly bolt hole 99. These bolt holes are for allowing bearing assembly bolts 34 to be inserted therethrough allowing the bearing assembly to be attached to the first and second shear plates (22, 24). Likewise the second bearing assembly half 64 has at least one seventh bearing assembly bolt hole 98' and at least one eighth bearing assembly bolt hole 99'. In a bearing of solitary construction, the seventh and eighth bearing assembly bolt holes would, of course, not be present.

Within the bearing assembly 60, it is preferred that at least one fifth bearing assembly bolt hole (98, 98') and at least one sixth bearing assembly bolt hole (99, 99') be provided. These bearing assembly bolt holes (98, 98', 99, 99') are able to align with bolt holes (90, 92, 94, 96) located in the first and second plates (22, 24) as shown. The preferred spacing of the fifth bearing assembly bolt holes (98, 98') from the sixth bearing assembly bolt holes (99, 99') is 15 3/8 inches. The preferred spacing between the fifth bearing assembly bolt holes, when more than one set is used, being 3 7/8 inches. The preferred spacing between the sixth bearing assembly bolt holes, when more than one set is used, being 3 7/8 inches. The preferred diameter of these bearing assembly bolt holes (98, 98', 99, 99') being 1 3/8 inches. The preferred recesses 58 comprise 1 7/8 inch by 2 3/8 inch by 7/8 inch deep mill pockets, a size that allows the preferred bolt heads to interfit therein.

Figure 6:
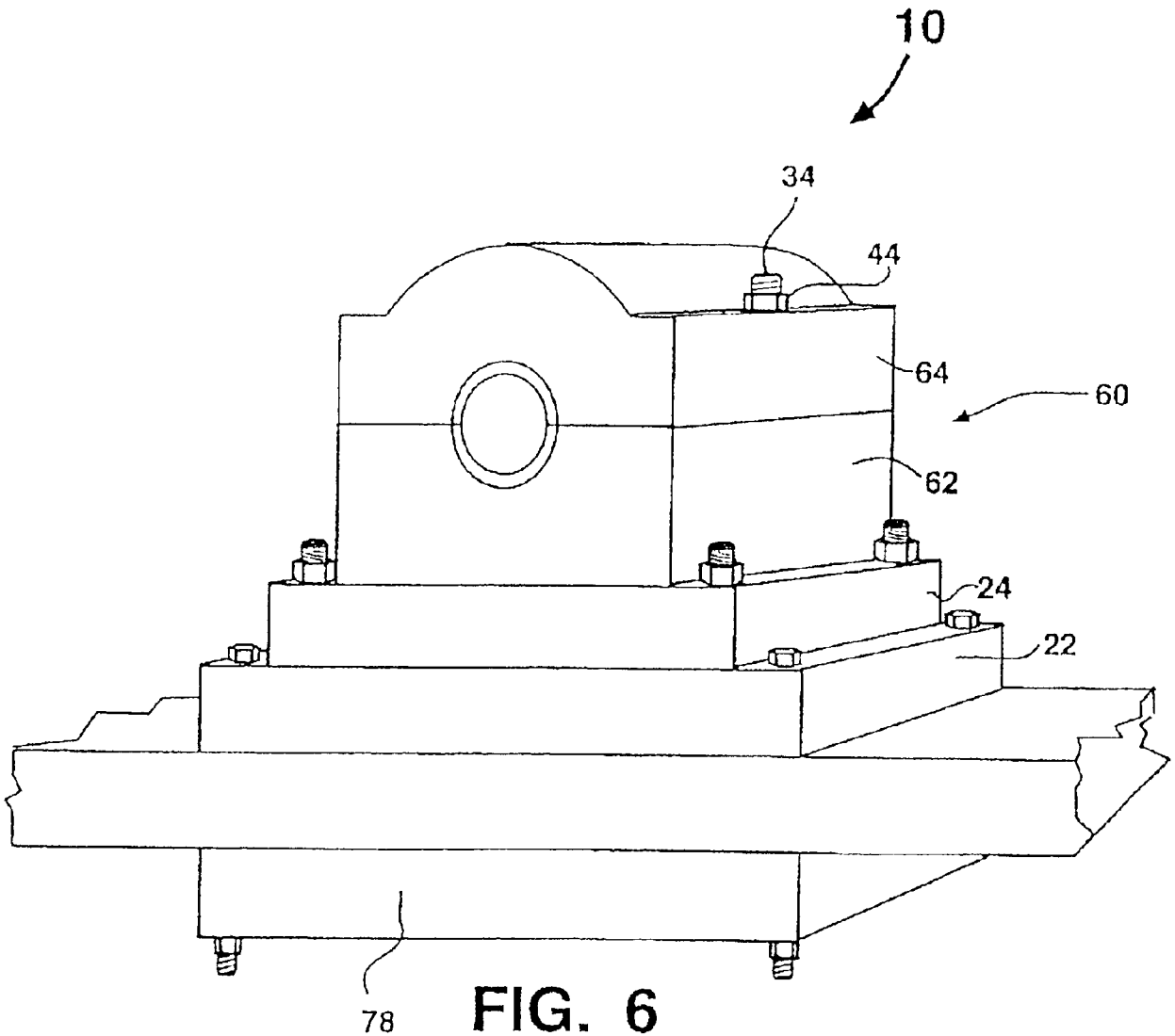
FIG. 6 is a perspective view of a fourth embodiment of the present invention.

Referring now to FIG. 6, another embodiment of the present invention 10 is shown. In this embodiment, the bearing assembly 60 has a first bearing assembly half 62 and a second bearing assembly half 64. This embodiment shows the utilization of a solitary bearing assembly bolt 34 and bearing assembly nut 44 to hold the bearing assembly upon the first and second shear plates (22, 24). As with any embodiment in this invention, the number of bolts utilized to bolt are particular portion to itself may be one or more. Also shown in this view, is the presence of a support plate 78 for further support of the present invention 10.

Figure 7:
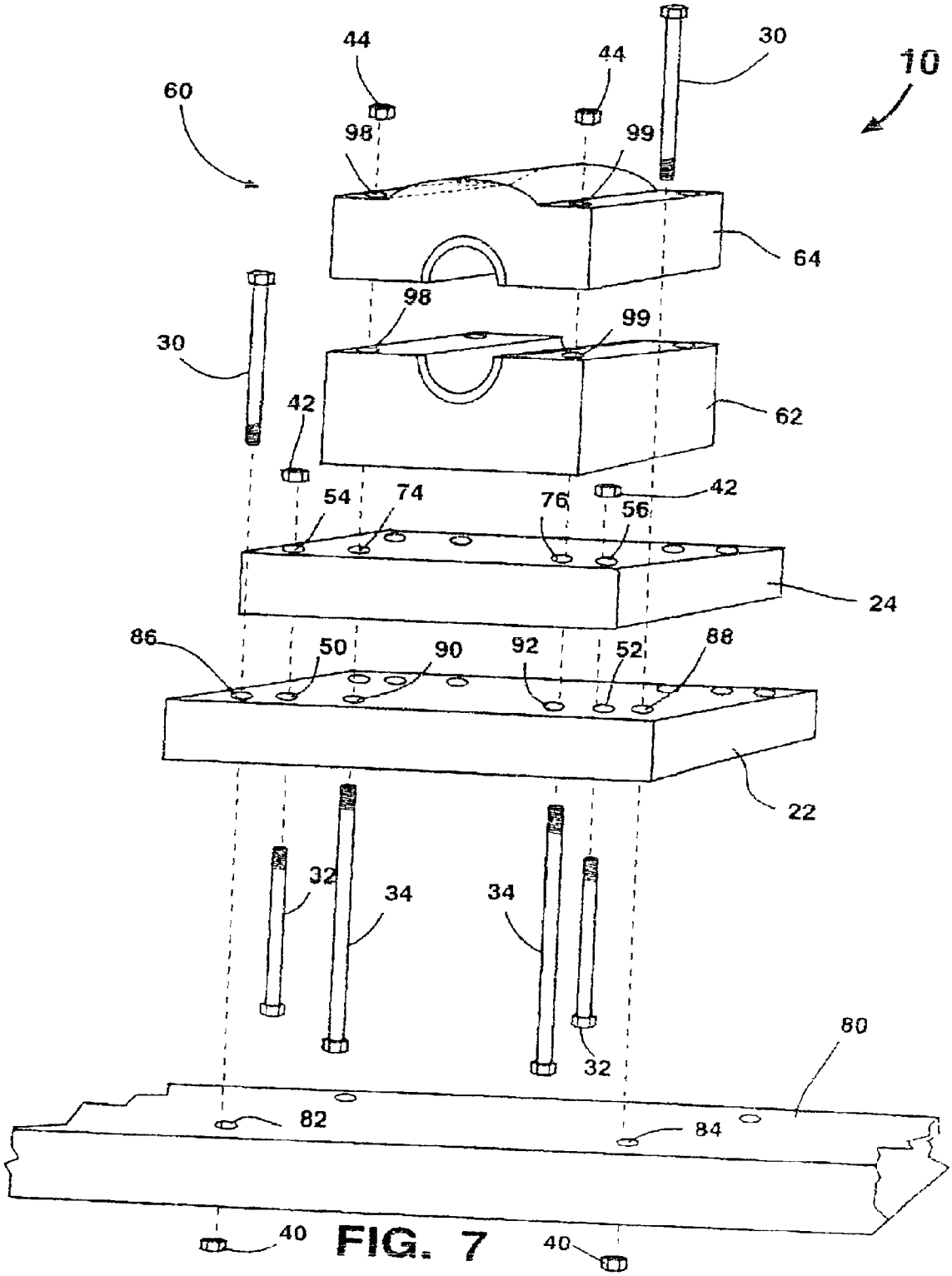
FIG. 7 is an exploded view of a fifth embodiment of the present invention.

Referring now to FIG. 7, an exploded view of another embodiment of the present invention 10 is shown. This embodiment shows the hardware (bolts and nuts) utilized to attach the foremost bolt holes. Likewise, it is intended that the rearmost bolt holes would have complementary hardware.

Figure 8:
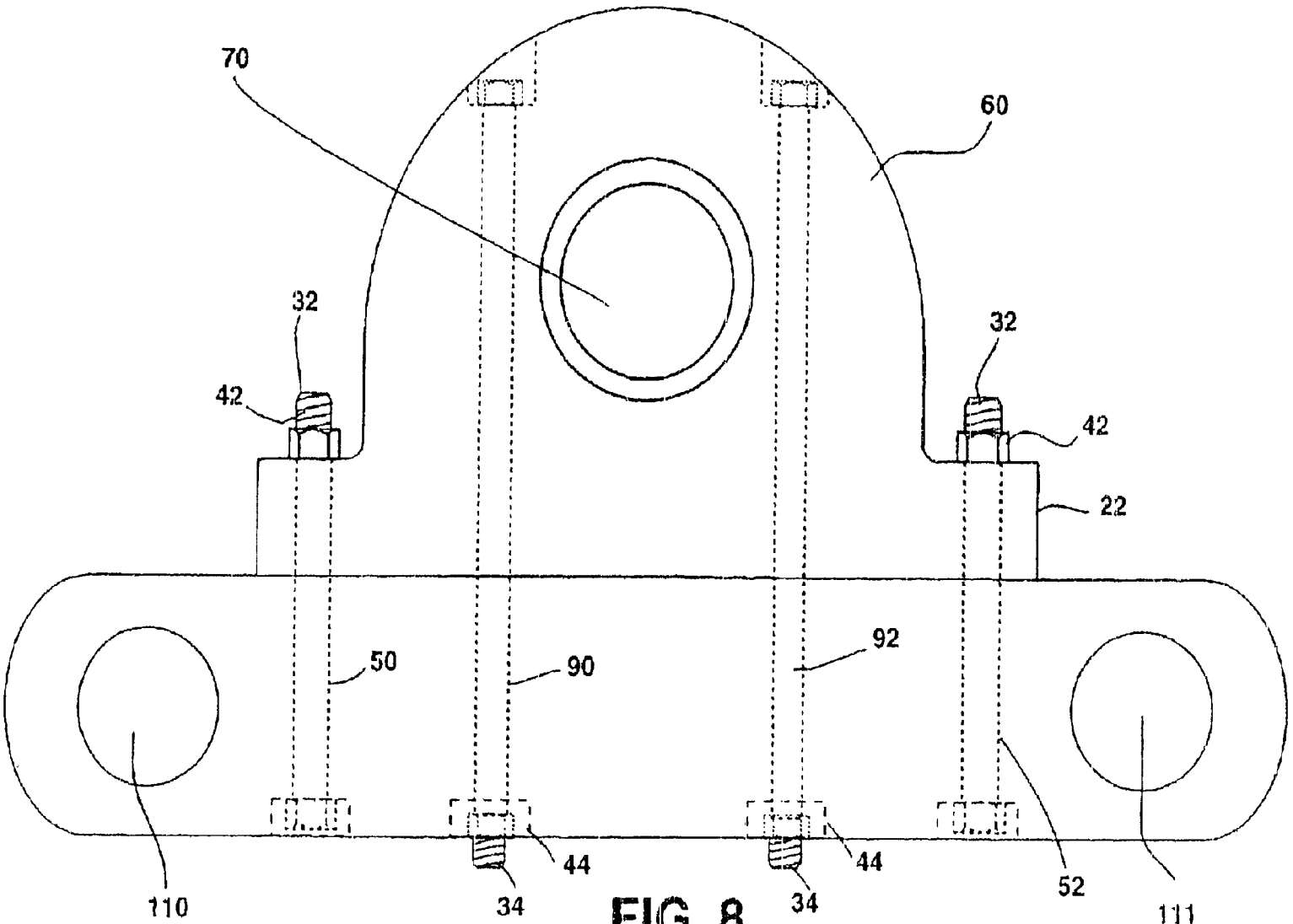
FIG. 8 is a plan view of the sixth embodiment of the present invention

Referring now to FIG. 8 we see another embodiment of the present invention. In this embodiment a bearing assembly 60 is attached to a first shear plate 22 by means of plate bolts 32 with corresponding plate nuts 42 attached through a first shear plate first bolt hole 86 and a first shear plate second bolt hole 88. The bearing assembly 60 is also connected by bearing assembly bolts 34 with corresponding assembly bolt nuts 44 attached through a first bearing assembly bolt hole 90, and a second bearing assembly bolt hole 92. The first shear plate further comprises a first opening 110, and a second opening 111 each opening adapted to receive a shearing pin 112 therethrough.

Figure 9:
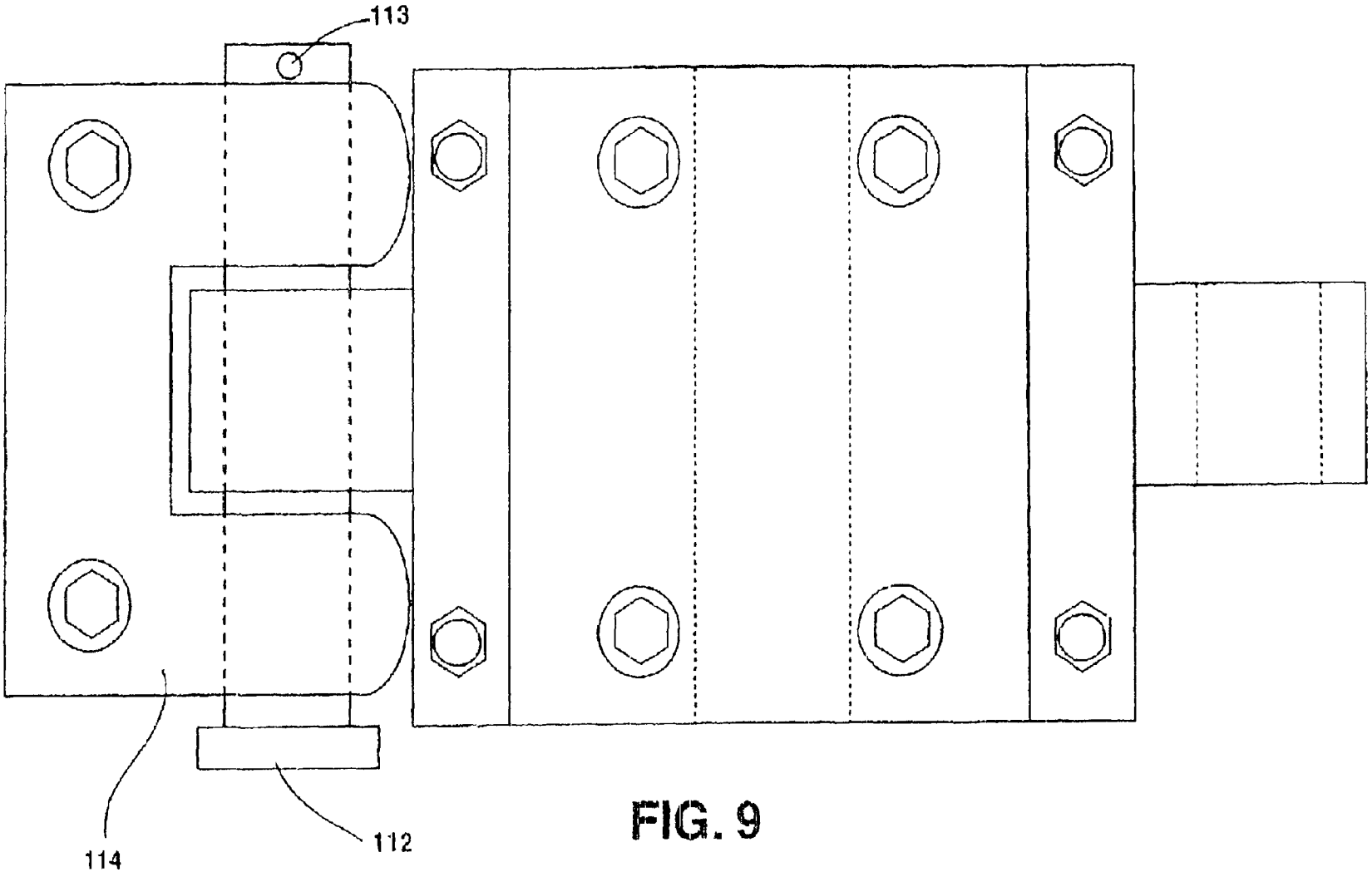
FIG. 9 is a top plan view of a sixth embodiment of the present invention.

In use as shown by FIG.9 the first and openings 110, and 111, (not shown) are aligned with corresponding holes in a frame bracket 114 and a shear pin 112 with a corresponding keeper key 113 is inserted therethrough. This holds the mounted assembly in place until a shearing force is placed upon the system. When this occurs the shear pin 112 will break and the assembly will fall. In order to repair the system after the break, all that a party needs to do is remove the broken pieces, realign the openings of the shear plate with the openings of the mounting bracket and insert a new shear pin. The frame bracket may be either a part of the frame or a separate entity attached to the frame.

While there is shown and described the present preferred embodiment of the invention, it is to be distinctly understood that this invention is not limited thereto but may be variously embodied to practice within the scope of the following claims.

I claim:

1. A breakaway bearing mount comprising:

a frame having at least one receiving hole for receiving a shearing device therein;

a lower shear plate defining at least one shear plate shearing device hole adapted to receive one or more shearing devices, said shearing devices having a shear strength, with said lower shear plate attached to said frame by said one or more shearing devices and said lower shear plate attached to a bearing assembly;

a bearing assembly enclosing a rotatable shaft, said bearing assembly including said one or more bearing assembly connectors, said bearing assembly configured for mounting to said lower shear plate through one or more bearing assembly connectors having a shear strength greater than said shear strength of the shearing device;

wherein the one or more shearing devices are configured to break before the bearing assembly connector when the shaft is subjected to a predetermined minimum stress.

2. The breakaway bearing mount of claim 1 wherein said one or more shearing devices are shear bolts having a corresponding shear bolt nut.

3. The breakaway bearing mount of claim 1 wherein said one or more shearing devices are shear pins having a closure.

4. The breakaway bearing mount of claim 1 wherein said bearing assembly connectors are bearing bolts having a corresponding bearing nut.

5. The breakaway bearing mount of claim 1 which further comprises:

an upper shear plate defining at least one upper shear plate shearing device hole, attached to said lower shear plate through use of at least one upper shear plate shearing device extending through at least one upper shear plate shearing device hole, and having a bearing assembly connector for connecting said upper shear plate to said bearing assembly, wherein the shearing strength of the upper shearing device is greater than the shearing strength of the lower shearing device but less than the shearing strength of the bearing assembly connection means.

6. The breakaway bearing mount of claim 5 wherein said bearing assembly further comprises:

a first bearing assembly portion defining a first plurality of bearing assembly bolt holes, the first bearing assembly portion configured for mounting to said lower shear plate through said bearing bolts extending through bearing bolt holes, with said bearing bolts attaching through use of corresponding nuts, said first bearing assembly rotatably supporting a first end of said shaft; and a second bearing assembly portion defining a second plurality of bearing bolt hales, said second bearing assembly portion configured for mounting to an upper shear plate through said bearing assembly bolts extending through the second plurality of bearing bolt holes, said second bearing assembly rotatably supporting said second end of said shaft.

7. The breakaway bearing mount of claim 6 in which said lower shear plate and said upper shear plate further include a plurality of bolt head recesses for containment of bolt heads of the bearing bolts and shear bolts.

8. The breakaway bearing mount of claim 6, wherein said lower and upper bearing assemblies are pillow block bearings.

9. The breakaway bearing mount of claim 5 in which said lower shear plate and said upper shear plate further include a plurality of bolt head recesses for containment of bolt heads of the bearing assembly shear bolts.

10. The breakaway bearing mount of claim 9, wherein said first and second bearing assemblies are pillow block bearings.

11. The breakaway bearing mount of claim 1 in which said shaft includes an attached hammermill.

12. The breakaway bearing mount of claim 1 wherein said bearing assembly further comprises:

a first bearing assembly portion defining a first plurality of bearing assembly bolt holes, the first bearing assembly portion configured for mounting to said lower shear plate through said bearing assembly connectors extending through the first plurality of bearing assembly bolt holes and the first plurality of assembly bolt holes, with said bearing assembly bolts attaching through use of corresponding nuts, said first bearing assembly rotatably supporting a first end of said shaft; and a second bearing assembly portion defining a second plurality of bearing assembly bolt holes, said second bearing assembly portion configured for mounting to a upper shear plate through said bearing assembly connectors extending through the second plurality of bearing assembly bolt holes and the second plurality of assembly bolt holes, said second plurality of bearing assembly bolts able to be attached through use of corresponding nuts, said second bearing assembly rotatably supporting said second end of said shaft.

13. The breakaway bearing mount of claim 12 wherein said lower shear plate and upper shear plate are mounted to said frame through use of a plurality of shear bolts extending through a plurality of shear bolt holes, and attached through use of a plurality of corresponding nuts.

14. A combination comprising:

a rotatable shaft, said shaft having a first shaft end and a second shaft end;

a frame;

a first shear plate mounted to said frame through use of at least one plate shear bolt;

a second shear plate mounted to said frame through use of at least one plate shear bolt;

a first bearing assembly mounted to said first shear plate through use of at least one bearing shear bolt, said first bearing assembly rotatably supporting said first shaft end; and a second bearing assembly mounted to said second shear plate through use of at least one shear bearing bolt, said second bearing assembly rotatably supporting said second shaft end; wherein said plate shear bolts are configured to a lesser shear strength rating than said bearing shear bolts, and in which said plate shear bolts are configured to break prior to the bearing shear bolts when subjected to a shearing force.

15. The combination according to claim 14, wherein said bearing assemblies are pillow block bearings.

16. The combination according to claim 15, wherein said shall further comprises a hammermill attached to said shaft.

17. A bearing assembly for use with a rotatable shaft, said bearing assembly comprising:

a shear plate mounted to a frame through use of at least one plate shear bolt;

a bearing mounted to said shear plate through use of at least one bearing shear bolt with a bolt head, said bearing rotatably supporting said shaft; wherein said at least one shear plate bolt is configured to a lesser shear strength than said at least one bearing shear bolt, and said at least one plate bolt is configured to break before said at least one bearing shear boll when subjected to a shear force.

18. The bearing assembly for use with a rotatable shaft of claim 17 in which said shear plate further includes a bolt head recess for each bearing shear bolt, for containment of bolt heads of said bearing assembly shear bolts.

19. The bearing assembly of claim 17, wherein said bearing is a pillow block type bearing.

20. A breakaway bearing assembly, for supporting a shaft and a hammermill, comprising:

a shaft, said shaft having a first shaft end and a second shaft end;

a frame defining at least two frame bolt holes for receiving at least one frame shear bolt from a first lower shear plate and at least one frame shear bolt from a second lower shear plate;

a first and second lower shear plate with each defining at least one first shear bolt hole, wherein said first and second lower shear plates are configured for attachment to said frame through use of said frame shear bolts extending into said frame bolt holes and said lower shear plate bolt hole, with said first and second lower shear plates each further defining at least one upper shear plate bolt hole, each for receiving a second shear bolt;

a first and a second upper shear plate each defining at least one second shear bolt hole wherein said first and second upper shear plates are configured for mounting to said respective first and second lower shear plates through use of said second shear bolts extending through said first and second lower and upper shear bolt holes and connecting said respective first and second upper and lower shear plates with at least one second shear bolt, said first and second upper shear plates further defining a plurality of bearing bolt holes;

a first bearing assembly defining a plurality of bearing assembly bolt holes, said first bearing assembly configured for mounting to said first upper shear plate using a plurality of bearing assembly bolts extending through said bearing assembly bolt holes and said bearing bolt holes, said first bearing assembly rotatably supporting the first shaft end; and a second bearing assembly defining a plurality of bearing assembly bolt holes, said second bearing assembly configured for mounting to said second upper shear plate using a plurality of bearing assembly bolts extending through said bearing assembly bolt holes and said bearing bolt holes, said second bearing assembly rotatably supporting the second shaft end; wherein each of said frame shear bolts and said second shear bolts are configured to a lower shear rating that said bearing assembly bolts and thus said frame shear bolts and said second shear bolts are configured to break before said bearing assembly bolts when said shaft is subjected to a predetermined minimum stress.

21. The breakaway shaft bearing mount of claim 20 wherein said first and second shear plates further include a plurality of bolt head recesses for containment of bolt heads of said bearing assembly shear bolts.

22. A breakaway bearing assembly, for supporting a shaft and a hammermill, comprising:

a shaft, said shaft having a first shaft end and a second shaft end;

a frame defining at least two frame bolt holes for receiving at least one frame shear bolt from a first lower shear plate and at least one frame shear bolt from a second lower shear plate;

a first and second lower shear plate with each defining at least one first shear bolt hole, wherein said first and second lower shear plates are configured for attachment to said frame through use of said frame shear bolts extending into said frame bolt holes and said lower shear plate bolt hole, with said first and second lower shear plates each further defining at least one bearing bolt holes, each for receiving a bearing bolt;

a first bearing assembly defining a plurality of bearing assembly bolt holes, said first bearing assembly configured for mounting to said first lower shear plate using a plurality of bearing assembly bolts extending through said bearing assembly bolt holes and said bearing bolt holes, said first bearing assembly rotatably supporting the first shaft end; and a second bearing assembly defining a plurality of bearing assembly bolt holes, said second bearing assembly configured for mounting to said second lower shear plate using a plurality of bearing assembly bolts extending through said bearing assembly bolt holes and said bearing bolt holes, said second bearing assembly rotatably supporting the second shaft end; wherein each of said frame shear bolts are configured to a lower shear rating that said bearing assembly bolts and thus said frame shear bolts and said second shear bolts are configured to break before said bearing assembly bolts when said shaft is subjected to a predetermined minimum stress.

23. A breakaway bearing mount comprising:

a frame having at least one receiving hole for receiving a shearing device therein;

a lower shear plate defining at least one shearing device hole adapted to receive one or more shear bolts, said shear bolts having a shear strength, and used with a corresponding nut, with said lower shear plate attached to said frame by said one or more shear bolts and said lower shear plate attached to a bearing assembly;

a bearing assembly enclosing a rotatable shaft, said bearing assembly including one or more bearing bolts, said bearing bolts configured for mounting to said lower shear plate and a shear strength greater than said shear strength of the shear bolts;

wherein the one or more shear bolts are configured to break before the bearing bolts when the shaft is subjected to a predetermined minimum stress.

* * * * *